United States Patent [19]

Hibbard

[11] 4,352,733

[45] Oct. 5, 1982

[54] GOLD AND SILVER SEPARATOR

[75] Inventor: William M. Hibbard, McCall, Id.

[73] Assignee: His Way

[21] Appl. No.: 218,985

[22] Filed: Dec. 22, 1980

[51] Int. Cl.[3] ..... B03B 5/00

[52] U.S. Cl. ..... 209/430; 209/501

[58] Field of Search ..... 209/428–430, 209/431–433, 470, 500, 501, 380, 271, 63, 50, 59, 70, 307, 308, 451

[56] References Cited

U.S. PATENT DOCUMENTS

| | | | |
|---|---|---|---|
| 236,023 | 12/1880 | Hastings | 209/470 X |
| 416,704 | 12/1889 | Holland . | |
| 473,449 | 4/1892 | Cudner . | |
| 544,880 | 8/1895 | Bouk | 209/430 |
| 651,822 | 6/1900 | Burnett | 209/430 X |
| 680,678 | 8/1901 | Thronburgh . | |
| 682,749 | 9/1901 | Roberts | 209/429 |
| 1,198,342 | 9/1916 | Giffen | 209/430 X |
| 2,103,663 | 1/1935 | Curtis . | |
| 2,325,562 | 2/1956 | Hackney et al. . | |
| 2,518,605 | 8/1950 | Drew | 209/428 |
| 2,825,462 | 3/1958 | Hackney | 209/430 |
| 2,930,484 | 3/1960 | Rodman . | |
| 3,713,537 | 1/1973 | Walker | 209/307 |
| 3,744,632 | 7/1973 | Mozley | 209/500 X |
| 3,976,567 | 8/1976 | MacElvain | 209/430 |
| 4,060,482 | 11/1977 | Burt | 209/432 |
| 4,140,483 | 3/1979 | Lee | 209/308 X |

FOREIGN PATENT DOCUMENTS

| | | | |
|---|---|---|---|
| 20843 | 1/1936 | Australia | 209/428 |
| 67821 | 11/1891 | Fed. Rep. of Germany | 209/428 |
| 132570 | 8/1901 | Fed. Rep. of Germany | 209/430 |
| 1123805 | 6/1956 | France | 209/428 |
| 329030 | 5/1930 | United Kingdom | 209/430 |

*Primary Examiner*—Tim R. Miles

*Attorney, Agent, or Firm*—Sughrue, Mion, Zinn, Macpeak & Seas

[57] ABSTRACT

An apparatus for separating gold and silver from a mixture of sand and rock comprises an endless conveyor supported on an inclined plane on a base. A motor connected to a source of electrical power is connected to a driven roller which operates the conveyor, liquid conducting pipes are placed adjacent the endless conveyor for discharging liquid onto the conveyor belt as it rotates upwardly, means for supplying liquid under pressure to the liquid conducting pipes is provided together with means for depositing a mixture of sand and rock onto the conveyor belt. The mixture of sand and rock is washed by streams from the pipes thus separating lighter materials from heavier particles, the former of which flow down the conveyor belt with the liquid into a trough and the latter heavier particles of gold and silver continue to adhere to the conveyor belt and are dislodged by liquid dripping on to the conveyor belt as it turns over the driven roller. The gold and silver particles thus dislodged gravitate into a trough and are subsequently deposited into a container at the end thereof.

5 Claims, 6 Drawing Figures

GOLD AND SILVER SEPARATOR

BACKGROUND OF THE INVENTION

1. Field of the Invention

This invention pertains to an apparatus for separating gold and silver particles from heavy concentrate or black sand.

2. Statement of the Prior Art

There is no prior art which shows the use of inclined conveyors using smooth or lightly textured belts to carry very fine ore concentrates (i.e., heavy concentrates or black sand) upwardly and which are washed by water streams directed onto the conveyor, thus washing back and separating the lighter and/or round particles of materials in the black sand from the heavier and flat-like particles of gold and silver contained in the black sand. Because of their flatness and density, the particles of gold and silver adhere to the conveyor belt while other more round or light materials wash down and off the belt.

Unlike the present invention, the prior art designs only purport to separate rough mill-run ore into heavy or black sand components through the use of traps on their conveyor belts. The heavy or black sand components of the material used with this invention will contain such elements as zircon, hematite, magnetite, monazite, etc., in addition to gold and silver. This invention takes the end product of the prior art devices and through its especially designed water medium and smooth belt, separates that product down to pure gold and silver, washing away the other materials contained in the heavier components or black sand.

Also, unlike the present invention, the prior art devices do not disclose: a compact gold and silver separator unit having a motor for rotating an endless conveyor belt upwardly against a source of water or fluid under pressure which washes the ore deposited on the conveyor; a funnel for directing materials to be separated onto the conveyor belt; and a pump for pumping water or fluid from a reservoir. Representative of prior art devices are those listed below:

| Patentee | Pat. No. | Issue Date |
|---|---|---|
| H. P. Holland | 416,704 | Dec. 3, 1889 |
| G. L. Cudner | 473,449 | Apr. 26, 1892 |
| G. W. Thornburgh | 680,678 | Aug. 13, 1901 |
| E. S. Curtis | 2,103,663 | Jan. 7, 1935 |
| R. Hackney et al | 2,325,562 | Feb. 20, 1956 |
| N. H. A. Rodman | 2,930,484 | March 29, 1960 |
| MacElvain et al | 3,976,567 | Aug. 24, 1976 |

SUMMARY OF THE INVENTION

This invention relates to an apparatus for separating gold and silver particles from sand and rock. The invention provides an effective and easy means for retrieving small particles of gold and silver from sand and rock, commonly known as black sand.

It is one object of this invention to provide an apparatus which eliminates the use of mercury and other chemicals previously used to separate gold particles from sand or the like.

It is another object of this invention to provide an apparatus for separating gold and silver particles from black sand or heavy concentrates which combines a motor operated endless conveyor belt for carrying a mixture of black sand, gold, silver and other materials to be separated.

It is another object of this invention to provide a gold and silver separator having a source of water or fluid under pressure and which is directed against the endless conveyor at separate and distinct locations for separating light particles of sand from heavier concentrates containing particles of gold and silver which are subsequently deposited in separate troughs located at the ends of the conveyor.

It is still another object of this invention to provide a gold and silver separator which may be connected to a source of external water pressure used in conjunction with a conveyor for separating gold particles from lighter materials.

It is yet another object of this invention to provide a gold and silver separator, the endless conveyor of which has a motor which is operated from a conventional power source or from a self-contained electrical source such as a battery.

These and other objects of the present invention will become apparent from a consideration of the following specification when read in conjunction with the annexed drawings.

DESCRIPTION OF THE PREFERRED EMBODIMENT OF THE INVENTION

Figure 1:
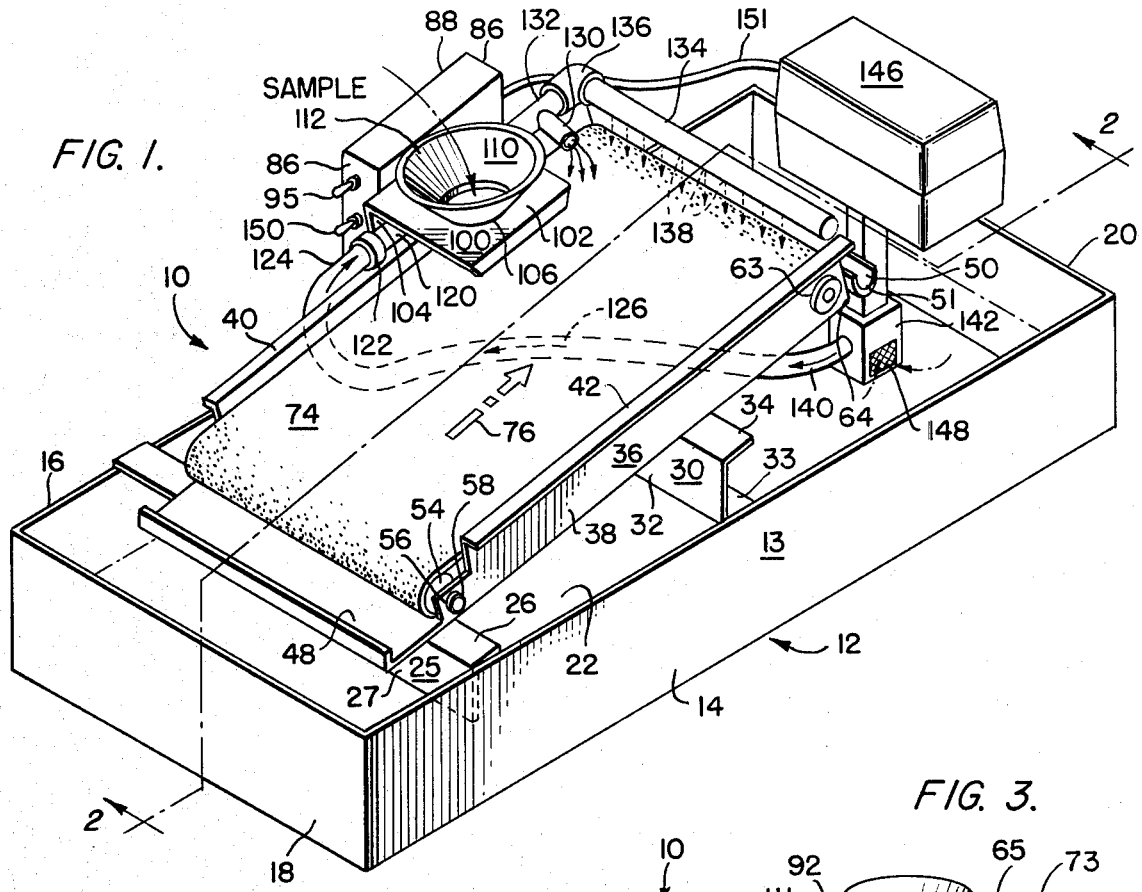
FIG. 1 is a perspective view of the gold and silver separator showing an inclined endless conveyor supported on a container, a funnel for receiving material to be deposited onto the endless conveyor, two sources of water directed against the endless conveyor for washing and separating gold and silver particles from lighter materials and a pump for pumping the water onto the endless conveyor.
Figure 3:
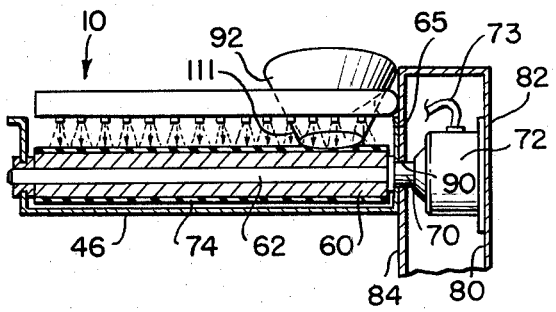
FIG. 3 is an end view of the gold and silver separator taken along the line 3—3 of FIG. 2 and shows a motor for driving a roller about which the endless conveyor turns, a water bar directing a low pressure streams of water or fluid adjacent the conveyor as it begins to turn over the upper driven roller.
Figure 2:
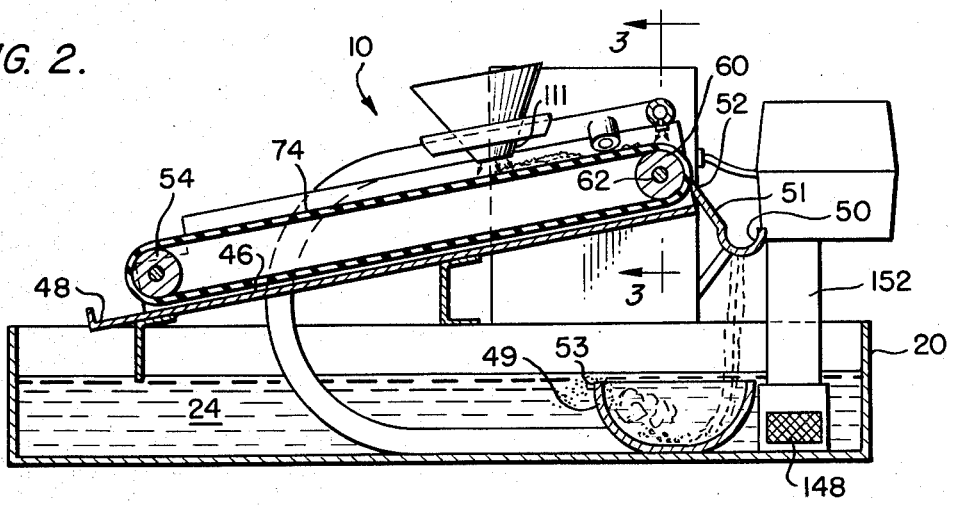
FIG. 2 is an end view of the gold and silver separator taken along the line 2—2 of FIG. 1 and shows an endless conveyor on an inclined plane mounted on rollers, water streams for washing and separating gold and silver particles from sand or the like, a pump extending into a container holding water or fluid to be pumped onto the endless conveyor.

Referring in more detail to the drawings, FIGS. 1–3 show a gold and silver separator 10 which includes a support 12 in the form of a container 13 having side walls 14 and 16, end walls 18 and 20 and a bottom 22.

The container 13 thus constructed is adapted to hold a quantity of water 24 or other liquid for purposes to be explained below.

An angle iron 25 having a vertical leg 27 and an upwardly projecting leg 26 is secured between side walls 14 and 16 adjacent end wall 18. A generally U-shaped member 30 having a vertical leg 32, a horizontal leg 33 and an upwardly projecting leg 34 is secured by horizontal leg 33 between side walls 14 and 16 a distance slightly greater than midway between end walls 18 and 20. The angle iron 25 and U-shaped member 30 support a tray 36 in an inclined plane as shown. In certain situations, the tray may be supported in a tiltable fashion so as to adjust the angle of inclination thereof. This may be easily done by removing angle iron 25 and pivotally attaching the tray to the U-shaped member 30. The tray 36 has vertical side walls 38 and 40 having horizontal flanges 42 and 44 thereon, a bottom wall 46, a trough 48 at one end of the tray and a trough 50 depending from the opposite end thereof. The trough 50 is of generally U-shaped configuration and has an upwardly slanting surface 51 and a doctor blade edge 52 at the end thereof. The trough 50 is constructed such that it slants downwardly away from side wall 40 of the tray 36. A removable cup 49 or container may be positioned adjacent to and below the end 51 of the trough so as to catch particles of gold which have been previously separated from sand. The cup 49 is concave and is placed in the container is such that its rim 53 is slightly below the water line. Gold and silver particles drop off the end of trough 50 and fall into the cup, striking the concave surface. This action causes swirling of the liquid within the cup and serves to loosen light particles from the gold and silver. These light particles float to the top of the cup, and over the edge and into the container.

A roller 54 is rotatably supported in bearings 58 which are secured in the side walls 38 and 40 at ends 56 thereof. A roller 60 having a shaft 62 is rotatably secured between side walls 38 and 40 by a bearing 63 in side wall 38 at end 64 thereof and by a hub 70 of a motor 72 at end 65. The motor 72 is drivingly attached by the hub 70 to the shaft 62 extending through and rigidly attached to the roller 60. A flexible belt 74 is positioned about the rollers 54 and 60 forming an endless conveyor. It has been determined that the belt should be manufactured of reinforced vinyl plastic, such as neoprene or other rubber-like materials which are used in irrigation projects because of the adhension capabilities such material presents to heavy ore particles such as gold.

The motor 72 is secured within a housing 80 which has side walls 82 and 84, end walls 86 and top and bottom walls 88 (one shown). The side wall 84 has an aperture 90 therein which is aligned with a similar aperture 92 in flange 40 adjacent end 65. The hub 70 of motor 72 passes through apertures 90 and 92 and is drivingly connected to shaft 62 for rotation thereof. The side wall 84 may be fastened to flange 40 by any suitable means such as welding or the like. The motor 72 is connected to a source of electricity through a switch 95 which has one end of an electrical cable 73 attached thereto, the other end of which is attached to the motor. Thus, when switch 95 is turned on, electric power reaches the motor 72 which rotates hub 70 extending therefrom and which in turn rotates the roller 60 by reason of its connection to shaft 62. Upon rotation of the roller 60, the endless belt 74 rotates in the direction of the arrow 76.

A bracket 100 having a horizontal platform 102 and a depending leg 104 is secured to flange 40 by any suitable means such as welding or the like. Platform 100 extends over the conveyor belt and has an aperture 106 therein into which a funnel 110 is inserted, the narrow end 111 of which extends below the platform and terminates near to the belt 74. This serves to control the flow of black sand onto the belt. The larger end 112 of the funnel extends above the platform 100 and is adapted to receive and deposit a quantity of black sand containing particles of gold and silver on to the conveyor belt 74.

A pipe 120 is fastened to the flange 44 and has a fitting 122 therein for receiving one end 124 of the flexible hose 126. Pipe 120 has an outlet nipple 130 adjacent end 132. End 132 is coupled to a water bar 134 by means of an elbow 136. The water bar 134 has a series of orifices 138 therein which extend along the bottom from end to end thereof.

The opposite end 140 of the flexible hose 126 is connected to the submerged chamber 142 of a fluid pump 146. The submerged chamber 142 has an inlet 148 which permits water or liquid within the container 12 to enter the interior of the submerged chamber. The pump 146 is connected to a source of electricity through a switch 150 located on the end wall 96 of housing 80. One end of a cable 151 is connected to the switch and the other end is connected to the pump. A second cable (not shown) connects a source of electricity to the switch. Thus, when the switch 150 is turned on, power is supplied to the pump 146 and liquid is caused to flow from the interior of the submerged chamber 142 through flexible hose 126, through pipe 120 exiting nipple 132 and the orifices 138. The pump 146 is suitably fastened within the container 12 and may be braced by any suitable means to the end wall 20.

In operation, the motor 72 is turned on by the switch 95 whereby the endless conveyor belt 74 begins to rotate very slowly. The pump 146 is turned on by the switch 150 and liquid such as water is pumped from the container 12 through the hose 126 and subsequently into pipe 120. The liquid is discharged from nipple 130 and from the orifices 150 of the water bar 134. The stream exiting the nipple 130 flows across the conveyor belt 74 in a generally slanted or oblique fashion from the nipple to side wall 38 of tray 36. It has been determined that a greater advantage would be obtained by causing the stream exiting the orifices 138 to diverge such that a portion of the stream would fall onto the conveyor 74 and flow downwardly therealong and another portion directed to flow over the belt as it turns over the roller 60. This performs the double function of keeping the belt wet and of dislodging the gold and silver particles from the belt as it goes over the roller 60.

A quantity of black sand containing gold and silver particles is deposited into the funnel 110 which is subsequently deposited on to the upwardly moving conveyor belt adjacent side 40 of tray 36. The advancing column of black sand containing gold and silver particles is washed across the conveyor belt 74 by the stream of liquid emanating from nipple 132. The lighter particles in the mixture are washed down the conveyor belt with the water and are deposited in tray 48. Particles of gold and silver which escaped the previous washing continue to adhere to the conveyor belt and are carried upwardly towards the water bar 138. As mentioned previously, a portion of the liquid exiting the orifices 138 strikes the conveyor belt forward of the roller 60 and functions to wet the belt. As the gold and silver particles which have continued to adhere to the conveyor belt advance with the belt over the roller 60, a portion of the liquid from the orifices 138 strikes the belt as it turns over the roller and functions to dislodge the gold and silver particles. The particles thus dislodged fall onto the downwardly slanting surface 51 and gravitate into the trough 50 for subsequent deposit into the cup 49. The downwardly slanting surface of the trough 50 has an edge 52 which abuts against the conveyor belt and serves to dislodge any additional gold particles which were not dislodged by gravity or by the fluid acting thereon.

The invention thus described, provides a machine which greatly improves the process of separating gold and silver from black sand and heavy concentrate in a simple, fast and efficient operation.

Figure 4:
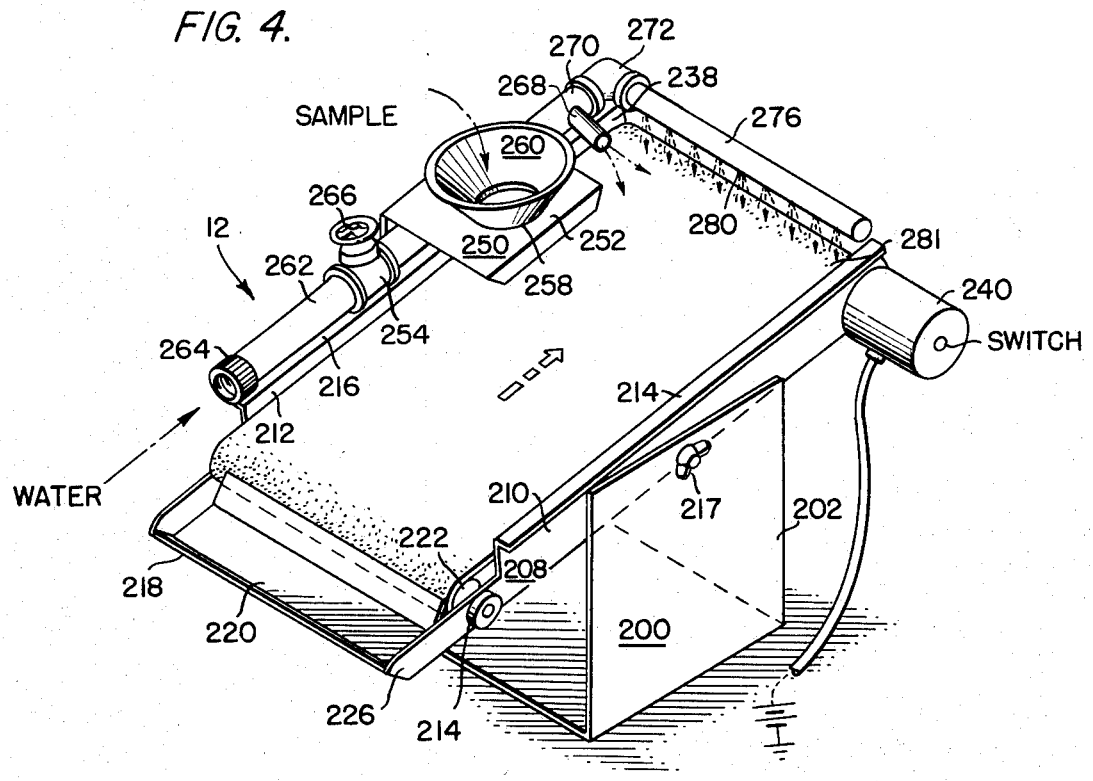
FIG. 4 is a perspective view of the gold and silver separator showing piping for connection to an external source of water or fluid and a battery operated motor for driving the endless conveyor about the rollers.
Figure 5:
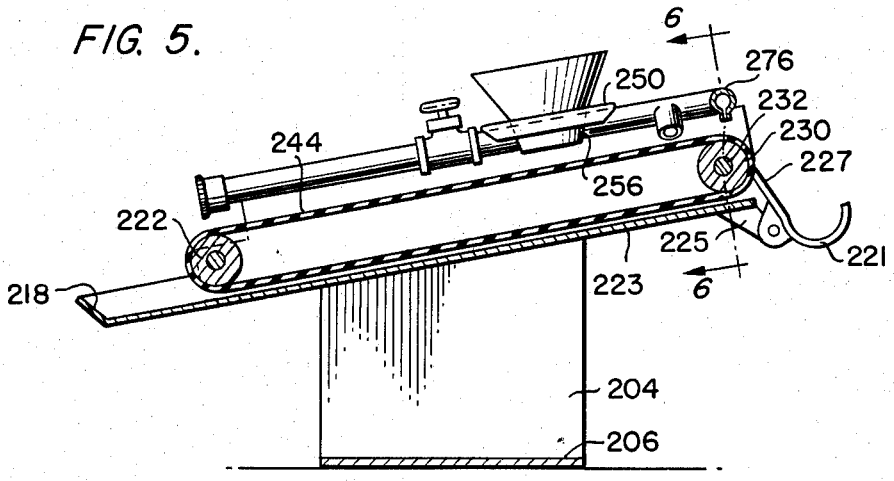
FIG. 5 is a side view of the gold and silver separator taken along the line 5—5 of FIG. 4 and is similar to FIG. 3 except that an external source of water or fluid is used and the support for the endless conveyor is a U-shaped support base.
Figure 6:
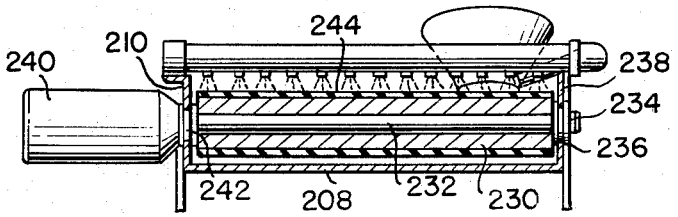
FIG. 6 is a end view of the separator showing a self-contained motor for turning the conveyor belt and a water bar adjacent the driven roller for directing a stream of water onto the conveyor belt as it begins to turn over the roller.

When the area to be worked contains an external source of water or liquid under pressure, the apparatus as shown in FIGS. 4–6 is used. In this connection, a U-shaped support 200 having side walls 202 and 204 and a base 206 supports a tray 208 in an adjustable, inclined plane. The tray 208 has vertical side walls 210 and 212 which have horizontal flanges 214 and 216 thereon. A flange 218 at the end 219 of the tray defines a trough 220 for catching waste material. A trough 221 is supported by a suitable bracket 225 adjacent end 223 of the tray. The tray is attached to side walls 202 and 204 by a wing nut 217 so that the inclination of the angle of the tray may be adjusted.

A roller 222 is rotatably supported in bearings 224 secured in ends 226 of walls 210 and 212. A roller 230 has a rod 232 extending therethrough and has one end 234 rotatably supported in a bearing 236 in end 238 of wall 212. A self-contained motor 240 has an output hub 242 drivingly connected to end 244 of a shaft 232 which extends through and is rigidly connected to the roller 244. The motor 240 is light enough to be supported by its hub 242 on the shaft 244. However, the hub 242 may be secured within an orifice in the side wall 210 in order to provide additional support for the motor. The motor 240 is connected to a source of electrical power such as a battery of suitable capacity.

An endless belt 244 is positioned about the rollers 222 and 230 and is rotated about the rollers by the motor 240 through the interconnection of the hub 242 and the shaft 232. A bracket 250 has a horizontal platform 252 extending over the conveyor belt and a depending leg 254 which is fastened by suitable means to side wall 212. The platform 252 has an aperture 256 extending therethrough and is adapted to support a funnel 260, the narrow end 258 of which extends below the platform and terminates adjacent the belt 244. A pipe 262 having a coupling 264 at the end thereof, a valve 266 adjacent the bracket 250, a discharge nipple 268 and an end 270 is fastened to flange 216 by suitable means such as by welding or the like. An elbow 272 connects end 270 of pipe 262 to a water bar 276 which has a series of orifices 280 therein. The bar extends across the conveyor belt adjacent the roller 230. As before, the orifices are arranged such that the streams diverges, one portion flows onto the conveyor belt down from roller 230 and the other portion flows over the roller. A source of liquid such as water is connected to the coupling 264. The valve 266 facilitates control of the quantity and pressure of the water to be discharged through nipple 268 and the orifices 280 onto the conveyor belt.

In operation, the apparatus just described is supported by base 206 on a suitable horizontal surface adjacent a supply of fluid under pressure. The fluid under pressure is connected by a hose to the coupling 264. The valve 266 is opened to allow the fluid to flow through discharge nipple 268 and the orifices 280 in water bar 276. The motor 240 is turned on and the conveyor belt rotates slowly upwardly in the direction of the arrow. A quantity of black sand containing gold and silver particles is deposited into the funnel 260 which is subsequently deposited onto the conveyor belt adjacent the side wall 212 of the tray 208. The advancing column of black sand containing gold and silver particles is washed across the conveyor belt by the liquid exiting the discharge nozzle 268. The material is distributed across the conveyor belt from side to side thereof in a slanting or oblique fashion from the discharge nipple 268 toward the end corner 281 of the tray adjacent the motor 240. The black sand, gold and silver particles are washed by this stream and lighter particles are washed down the conveyor belt with the liquid and are deposited into the tray 220.

Gold and silver particles which escaped the previous wash continue to adhere to the conveyor belt and move upwardly therewith toward the water bar 276. A portion of the liquid from the water bar exiting the orifices 280 strikes the conveyor belt forward of the roller 230 and serves to wet the belt so as to maintain good adhesion between the belt and gold and silver particles. The gold and silver particles continue to adhere to the surface of the conveyor belt and as they pass over the roller 230 a portion of the liquid exiting the water bar 276 via the orifices 280 strikes the conveyor belt just as it turns the roller and serves to dislodge gold and silver particles therefrom so that they fall into the trough 222. The gold particles thus deposited in the trough 222 are conveyed, due to the slanting nature of the trough, into a container at the end thereof. Should any gold and silver particles continue to adhere to the conveyor belt after it has turned the roller 230, the extension 227 of the trough abuts against the conveyor belt and serves as a doctor blade to dislodge gold and silver particles therefrom.

Although the invention has been described in detail with respect to its construction and operation, it is intended that the present disclosure of the preferred embodiment has been made only as an example and that numerous changes in the construction thereof may be resorted to without departing from the spirit and scope of the invention claimed herein so that it may be adoptable to other environments and for other uses.

What I claim is:

1. A gold and silver separator comprising:

a container for storing liquid;

an inclined tray supported above said container;

a rotatable conveyor supported on the tray;

a pump secured within the container;

a fluid conducting pipe having a discharge nipple thereon positioned on said tray adjacent a side and extending longitudinally thereof, said discharge nipple extending at an angle relative to the conveyor belt;

a water bar having a series of orifices therein, said water bar extending across the tray from side to side and adjacent the end thereof, said water bar connected to said fluid conducting pipe;

said discharge nipple being adjacent the water bar and adapted to direct liquid across the conveyor belt from side to side thereof in a slanting or oblique angle and said water bar at right angles to said fluid conducting pipe and positioned above the conveyor belt adjacent but forward of the end thereof, the orifices therein directed towards the conveyor belt and constructed such that a portion of the liquid emanating therefrom is directed onto the conveyor belt a distance forward of the end thereof and a second portion of the liquid flows over the conveyor belt as it turns over the driven roller, said fluid conducting pipe connected to said pump whereby fluid is pumped from the container through said pipe and said water bar onto the conveyor belt; and funnel means adjacent a side of the tray and connected thereto for depositing black sand and heavy concentrate onto the conveyor belt along one edge thereof whereby, upon being acted on by said liquid, the lighter particles are separated from the heavier gold and silver particles.

2. A gold and silver separator comprising:

a container for storing liquid;

a pair of cross members fastened between walls of the container, said cross members having upwardly extending projections extending above said container;

a tray supported on said upwardly extending projections such that said tray is above said container, said tray having side walls;

a pair of rollers mounted between said side walls at opposite ends of the tray;

an endless belt positioned between the rollers and maintain taut whereby the surface of said endless belt is perfectly smooth;

self contained electric motor means for driving one of the rollers;

a pump for pumping liquid stored within the container having one end submerged beneath liquid in said container and the opposite end extending above said container and means for connecting said opposite end of said pump to a source of electric power through on-off switching means;

liquid conducting means extending longitudinally of and adjacent the tray and having a discharge nipple at an angle, additional liquid conducting means intersecting said first mentioned liquid conducting means at right angles thereto and having orifices therein, said first mentioned liquid conducting means connected to the pump whereby liquid is directed onto the surface of said endless belt obliquely across the belt and downwardly across the belt by said discharge nozzle and said orifices; and means overlying the endless belt adjacent a side thereof for depositing black sand and heavy concentrate thereon, such that said black sand and heavy concentrate is deposited on a line adjacent the edge of the conveyor belt and is spread across the conveyor belt obliquely by said liquid from said discharge nozzle and washed by said liquid from said orifices in such fashion that the lighter particles are carried downwardly with said liquid to be deposited in a trough at the end of the tray and the heavier particles continue over the end of the conveyor belt to gravitate into a trough at the opposite end of the tray.

3. A gold and silver separator comprising:

a base;

a tray supported on an inclined plane on said base, said tray having side walls;

troughs on the ends of the tray;

a pair of rollers rotatably supported between said side walls, each of said rollers adjacent the ends of the tray;

an endless belt positioned about the rollers for rotation therewith, said endless belt is taut such that the surface thereof is perfectly smooth;

power means drivingly connected to one of the rollers to cause rotation thereof thus causing rotation of the endless belt;

liquid conducting means on the tray having plural outlets for discharging liquid over the endless belt, one outlet being a nozzle which directs fluid across the conveyor belt obliquely from side to side thereof and the other being a plurality of orifices in a water bar which directs said liquid downwardly onto the belt in such fashion, that one portion is directed onto the conveyor belt forward of the driven and the other portion is directed over the conveyor belt as it passes over the driven roller;

said liquid conducting means having a coupling for connecting to an external source of liquid under pressure, a valve thereon for controlling the amount of liquid flowing therein; and means overlying the endless belt for distributing a mixture of black sand containing gold and silver thereon, said means comprising a funnel attached to a side of the tray and extending over the conveyor belt in such fashion that the black sand containing gold and silver is deposited adjacent the edge of the conveyor belt for movement upwardly in a line whereby said mixture is washed by the liquid in such fashion that the lighter sand particles are separated from the gold and silver particles, the lighter particles being deposited in one trough and the gold and silver particles being deposited in the other trough.

4. A gold and silver separator as defined in claim 3, and:

said tray is detachably attached to said base and movable relative to said base such that the angle of inclination of the tray may be adjusted.

5. A gold and silver separator as defined in claim 3, and:

a concave cup below the end of said other trough and submerged beneath the liquid for catching gold and silver particles dropping from the edge of said trough.

* * * * *